US011100906B1

(12) United States Patent
Mohr

(10) Patent No.: US 11,100,906 B1
(45) Date of Patent: Aug. 24, 2021

(54) LAMINATED BOW FOR STRINGED MUSICAL INSTRUMENTS

(71) Applicant: Mohr & Mohr, Ashland, OH (US)

(72) Inventor: Rodney D. Mohr, Ashland, OH (US)

(73) Assignee: Mohr & Mohr, Ashland, OH (US)

( * ) Notice: Subject to any disclaimer, the term of this patent is extended or adjusted under 35 U.S.C. 154(b) by 0 days.

(21) Appl. No.: 17/009,877

(22) Filed: Sep. 2, 2020

(51) Int. Cl.
*G10D 3/16* (2020.01)

(52) U.S. Cl.
CPC ..... *G10D 3/16* (2013.01)

(58) Field of Classification Search
CPC ..... G10D 3/00; G10D 3/16; G10D 3/166
See application file for complete search history.

(56) References Cited

U.S. PATENT DOCUMENTS

| | | | | |
|---|---|---|---|---|
| 2,252,929 | A | 8/1941 | Heddon | |
| 2,487,442 | A | 11/1949 | Hohl | |
| 3,440,918 | A | 4/1969 | Wurlitzer | |
| 3,456,544 | A | 7/1969 | Glasser | |
| 3,943,011 | A * | 3/1976 | Dromsky | B32B 15/011 428/683 |
| 4,015,501 | A | 4/1977 | Schaller | |
| 4,239,071 | A | 12/1980 | Ritchie | |
| 4,754,681 | A | 7/1988 | Maigret et al. | |
| 4,965,973 | A | 10/1990 | Engebretsen | |
| 5,002,105 | A | 3/1991 | Bodig | |
| 5,026,593 | A | 6/1991 | O'Brien | |
| 5,074,092 | A | 12/1991 | Norlander | |
| 5,362,545 | A | 11/1994 | Tingley | |
| 6,075,188 | A | 6/2000 | Wetzlinger et al. | |
| 7,262,353 | B2 | 8/2007 | Bartholomew et al. | |
| 2011/0247475 | A1 * | 10/2011 | Yamamoto | G10D 3/16 84/325 |

FOREIGN PATENT DOCUMENTS

| | | |
|---|---|---|
| GB | 903574 | 8/1962 |

* cited by examiner

*Primary Examiner* — Kimberly R Lockett
(74) *Attorney, Agent, or Firm* — Frank H. Foster; Kremblas & Foster

(57) ABSTRACT

A bow for a stringed musical instrument comprises resilient strips of bamboo, wood, or other wood-like materials, bonded together to form laminated layers. The principal layers are a central core layer, a top layer bonded to a top side of the core layer and a bottom layer bonded to a bottom side of the core layer. Each layer consists of one or more strips. The layers extend longitudinally along the shaft and are oriented perpendicularly to a plane that runs through a central axis of the shaft and a central axis of the hair of the bow. The top layer and the bottom layer preferably each comprise at least one strip of bamboo. The bamboo layers can produce the desired physical and playing characteristics that resemble those made with traditional exotic wood materials. It is beneficial to use bamboo as it is an organic, biodegradable, inexpensive and readily available material.

16 Claims, 4 Drawing Sheets

LAMINATED BOW FOR STRINGED MUSICAL INSTRUMENTS

BACKGROUND OF THE INVENTION

This invention is directly related to the field of bows for stringed musical instruments and more particularly to structural features of, materials for constructing, and a method for fabricating a bow for stringed musical instruments, including but not limited to violin, viola, cello and bass. The improvement provided by the invention is a bow structure and a method of constructing bows that create identical physical characteristics as high quality bows made of traditional materials, yet are constructed with readily available materials that are relatively inexpensive. Particularly advantageous is the use of a portion of bamboo (Poaceae) cane for constructing parts of the bow.

Centuries of bow-making by highly skilled craftsmen has led to bow construction standards and practices for construction that both optimize the sound volume created by talented musicians while facilitating responsiveness. The most sought-after physical characteristics include the bending strength or deflection, stiffness as well as flexibility, weight distribution, and balance. The bow should be sufficiently strong or stiff but with a degree of flexibility so that the musician is able to apply a wide range of pressure on the bow, transmitting that pressure to the strings of the instrument, to accommodate those with considerable technique. Consequently, the strength to weight ratio of a bow also is an important characteristic.

The visual quality of raw materials, such as knot placement and grain run-out or other defects, also is important for selecting materials for constructing a bow. For this purpose, a concern for visual quality is not necessary when using bamboo as when choosing a solid piece of wood from which to make a bow, however it remains necessary to determine the rate of deflection and modulus of elasticity of the material to gauge acceptance or failure of the raw materials selected for use in bow making.

Tradition among bow makers has developed a preference for very specific wood materials for constructing different component parts of the bow in order to create a bow that exhibits the coveted characteristics of highly acclaimed bows. One major reason for the tremendous monetary value of such bows is the rarity of the exotic wood materials that are traditionally used. Those materials have become extremely rare due to the fact that very few materials have the density to weight ratio that is necessary to accomplish the highly regarded playing characteristic. As a consequence, the remaining threatened materials continue to be depleted.

Wood has always been the main material in bow making. The terms "Wood" and "Wood-like Materials" refer to a hard, fibrous substance consisting basically of cellulose, xylem, and lignin that make up the greater part of the stems, branches, and roots of trees or shrubs beneath the bark, and to other fibrous substances naturally grown in soil or water, such as grasses including bamboo that can be used for making bows according to the invention. Exotic woods from South America have traditionally been the top choice because of their density and straightness of grain. Pernambuco and Brazilwood are the most common. Pernambuco (*Caesalpinia echinata*) grows along a narrow strip of land along the east coast of Brazil from the mouth of the Amazon River to Rio de Janeiro, where less than 10% of this forest remains. There are several sub-species of this wood, many of which are completely extinct, while others are rapidly nearing extinction.

The rarity of wood materials that are suitable for professional quality bows combined with the demand for those materials has caused ecological problems. In a world where there is constant pressure on natural resources, traditional materials for bow making have been especially impacted with nearly all materials becoming threatened or endangered. With the addition of Pernambuco to the CITES Treaty in September 2007, only wood readily available in the United States is considered a viable material, making it a highly coveted resource for the finest modern bow makers and restorers. The supply and demand for Pernambuco has increased the cost of the raw material so dramatically that it is often a hardship for new bow makers to purchase it. In turn, the ever-rising cost also has increased the purchase price of fine bows, financially burdening those with low to moderate means. Thus, the advent of a new era of alternative and sustainable materials for bow making is desperately needed.

Pernambuco has been traditionally chosen for its density, because its weight to strength ratio is a major factor for producing a bow that has the inherent strength to produce the volume of sound required to be heard in large venues, while maintaining the traditional weight and flexibility that permit musicians to make spontaneous and subtle inflections that are transmitted from the hand through the bow to the instrument.

To continue the fine art of bow making over the coming centuries, a quality resource and method of construction must be developed that continues to provide the same inherent properties and characteristics as Pernambuco. Many synthetic materials have been created during the $20^{th}$ century using resin infusion, carbon fiber wraps, and plastic injection molds that have been used to create bow-like objects. Although durability has been accomplished to some degree with these synthetic materials, these materials have been unsuccessful in providing musicians with a bow that performs as well as those made from a naturally responsive material like Pernambuco.

With the increasing use of synthetic materials, some of the pressure on resources has been lessened, however string musicians are unwilling to sacrifice the playing qualities inherent in wood that are absent from synthetic bows. When synthetic bows become worn or damaged, they are not likely to be repaired and most often are discarded. Importantly, these synthetic materials are not biodegradable and therefore significantly impact the environment when discarded into landfills. Fiberglass and carbon fiber bows require significant time to decompose and the resin used in conjunction to create them ultimately will cause significant distress to the environment in which we live. With thousands of bows being manufactured out of synthetic materials and discarded in one or two years, our landfills are likely to fill quickly with bows that require hundreds of years to decompose.

If readily available alternative, organic, wood-like materials were used instead of synthetic materials, a damaged bow could be easily discarded with virtually no environmental impact. The use of biodegradable materials instead of synthetic materials, like resin based with fiberglass and carbon fiber, makes these bows relatively non-biodegradable. With the use of alternative organic materials, the screw and eyelet of a bow are so small in size compared to the stick that very little metal will remain, eventually rusting as it turns into iron oxide. Importantly, bows made with an alternative organic material would rapidly decompose.

What is needed is a material, a bow structure, and a method of manufacture that will not harm the environment, but rather productively use an abundant supply of naturally invasive vegetation that can be created easily and inexpensively. Such bows also would have the ability to be mass produced to fill the market as student quality bows that can easily be discarded and replaced instead of using fiberglass or carbon fiber. Moreover, a need also exists to supply a bow for a stringed instrument that meets the needs of more advanced and professional musicians that can produce abundant sound quality, volume, playing characteristics, is internationally acceptable to Cites, and requires minimal maintenance.

It is therefore an object and purpose of the invention to provide a bow structure and a method for making a bow that can utilize readily available and inexpensive material that has the same highly prized characteristics as traditional expensive bows. These bows will be inexpensive to produce with readily available materials and will aid in the preservation of the environment by reducing the demand for and harvesting of traditional rare species of wood without contributing non-biodegradable materials to landfills.

SUMMARY OF THE INVENTION

The invention is a bow for a stringed musical instrument. For the purpose of this invention, the shaft of the bow comprises resilient strips of an adaptable material, such as bamboo, that when bonded together form laminated layers. The principal layers include a central core layer, a top layer bonded to a top side of the core layer and a bottom layer bonded to a bottom side of the core layer. Each layer consists of one or more strips. The strips and layers extend longitudinally along the shaft and are oriented perpendicularly to a plane that runs through a central axis of the shaft and a central axis of the hair of the bow. Preferably, the bow shaft itself consists of only those layers and has no surrounding cover layer but does have the usual head, frog, hair and button or adjuster mechanism attached to it. Importantly, the top layer and the bottom layer preferably each comprise at least one strip of bamboo. The bamboo layers are important because the top and bottom layers provide similar physical playing characteristics as bows made with traditional exotic wood materials.

Figure 1:
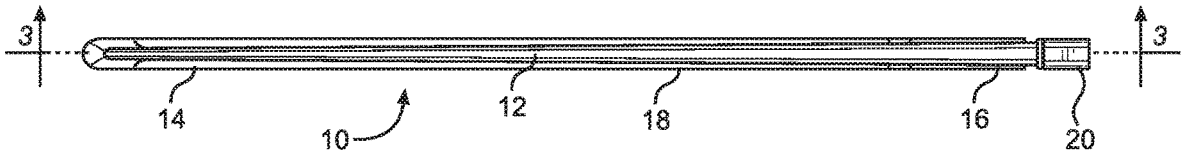
FIG. 1 is a top view of a bow for a stringed musical instrument that embodies the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Figure 2:
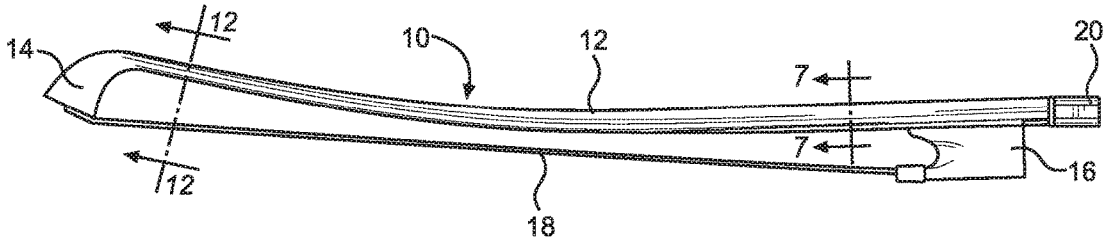
FIG. 2 is a side view of the bow illustrated in FIG. 1.

FIGS. 1 and 2 illustrate a bow 10 for a stringed musical instrument. The bow 10 has the conventional components that include a shaft 12, a head 14 attached to one end of the shaft 12, a frog 16 attached near the opposite end or handle end of the shaft 12, hair 18 extending between the head 14 and the frog 16 and a button 20. The frog 16, the hair 18 and the button 20 and its cooperating mechanism do not form a part of the invention and can be constructed according to the prior art. Although some embodiments of the invention include modifications of the head 14 construction, the head 14 can be shaped in a conventional manner.

Bow Structure

Figure 3:
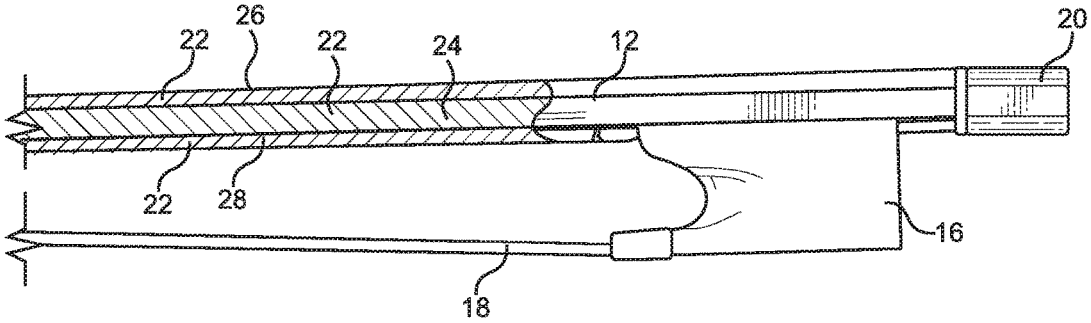
FIG. 3 is an enlarged side view of the frog end the bow illustrated in FIG. 1 with a segment of the shaft of the bow shown in cross section taken substantially along the line 3-3 of FIG. 1.
Figure 4:
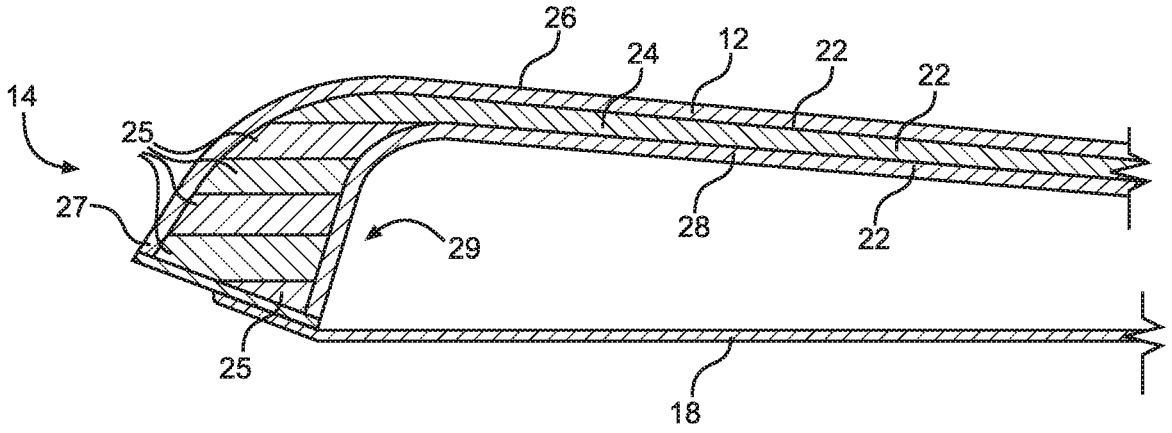
FIG. 4 is an enlarged side view of the head end of the bow illustrated in FIG. 1 shown in cross section taken substantially along the line 3-3 of FIG. 1

Referring to FIGS. 3 and 4, the shaft 12 is constructed as a plurality of resilient strips 22. The strips 22 are bonded together to form laminated layers. There are three principal layers. A central core layer 24 is sandwiched between a top layer 26 bonded to a top side of the core layer 24 and a bottom layer 28 bonded to a bottom side of the core layer 24. In order to assist in visualization, the words "top" and "bottom" are used as adjectives to refer to the relative locations of those principal layers when the bow is in its usual performance orientation. Each of the three principal layers can consist of one or more sub-component strips. A strip is an elongated sheet with flat surfaces on opposite top and bottom sides. It has a width that is at least twice its thickness between its opposite top and bottom sides. The strips of the principal layers extend longitudinally along the shaft. A plane that runs through the strips parallel to its top and bottom surfaces, and therefore runs through the strips, is laterally oriented perpendicularly to the plane of the bow. The plane of the bow is a plane that passes through a central longitudinal axis of the shaft and through a central longitudinal axis of the hair. The plane of the bow is shown by a dashed line in FIG. 12 and is the plane of the section line 3-3 of FIG. 1. Preferably the strips and principal layers all extend laterally entirely across the width of the shaft 12 so they are exposed on both sides of the shaft 12. Most conveniently, the layers and strips have a uniform thickness. However, the strips can alternatively have opposite upper and lower surfaces that are inclined to each other laterally or longitudinally or both. An alternative with such a structure is described below.

The physical characteristics of the top layer 26 and the bottom layer 28 are important. In particular the density of the material used to form the top layer 26 and the bottom layer 28 is a measure of the strength of the material usually expressed as specific gravity. The top layer 26 and the bottom layer 28 should be formed of a resilient, strong and flexible material having a specific gravity that is at least in the range of 0.95 to 1.2. Preferably, the top and bottom layers are formed of a resilient material that has a specific gravity in the range of 1 to 1.15 and most preferably a specific gravity in the range of 1 to 1.1, in order to construct a bow that exhibits the physical characteristics and appearance of a quality bow. The top layer 26 and the bottom layer 28 are preferably between 1 and 2 mm thick.

The inventor has found that the outer layer of bamboo (Poaceae) cane of some bamboo species [e.g. Tonkin Cane (*Pseudosasa ambilis*)] have a sufficient specific gravity that, when used as the top layer 26 and bottom layer 28 of a shaft embodying the invention, bamboo can provide a bow with similar physical characteristics desired by musicians in professional level bows. Although a bow can be advantageously constructed according to the invention, using other organic and wood-like materials as the layers and strips. The use of strips that are made of an outer layer of a bamboo cane is especially desirable because of their comparable specific gravity and other physical characteristics that lead to responsive bows, as well as being an inexpensive and biodegradable material that is in plentiful supply.

Figure 13:
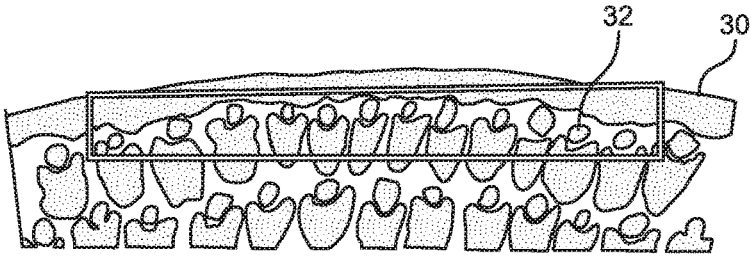
FIG. 13 is a view in transverse cross section of a segment of a bamboo cane illustrating the structure of a bamboo cane and the portion of the bamboo cane that is preferably used for embodiments of the invention.
Figure 14:
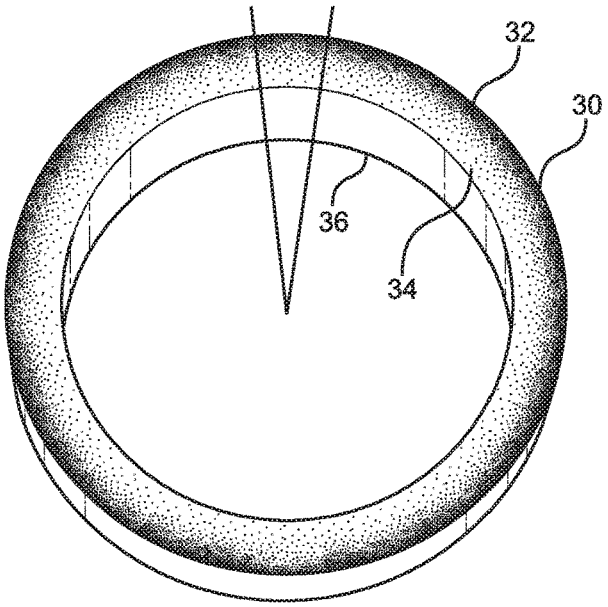
FIG. 14 is a view in transverse cross section of an entire bamboo cane showing the segment illustrated in FIG. 13.

FIG. 13 shows a cross section of a sector of a bamboo cane which is the sector illustrated in FIG. 14. The density of the bamboo cane varies from its maximum at the epidermis 30 at the outer surface to progressively less density radially inward through the cortex 32 and further into the flesh 34 to the pith 36. The rectangle in FIG. 13 encloses the portion of a bamboo cane that is preferably utilized for each bamboo strip in the top layer 26 and in the bottom layer 28. The top layer 26 and the bottom layer 28 of the shaft 12 are each formed of at least one strip and each strip in those layers should consist of some epidermis, cortex and an adjacent thin layer of flesh. By using bamboo as the top and bottom layers, the core layer can be constructed of one or more strips of wood, wood-like, or other material that has a lower specific gravity than bamboo. However, bamboo may be used for the core as well. The inventor theorizes that forming the top and bottom layers of bamboo with other laminated materials for the core layer allows the shaft to have a specific gravity in the ranges described above and be able to bend and function with the required strength.

The invention allows for variations that may be adopted in the material used for construction, as embodiments of the invention in the shape of the strips and principal layers and in the quantity of strips in each principal layer. Although bamboo is the preferred material for the top layer and the bottom layer, other materials may have an acceptable flexibility and may also have the required density to create a finished bow in the traditional strength or weight range. The core layer also may be formed of one or more strips of bamboo.

Figure 5:
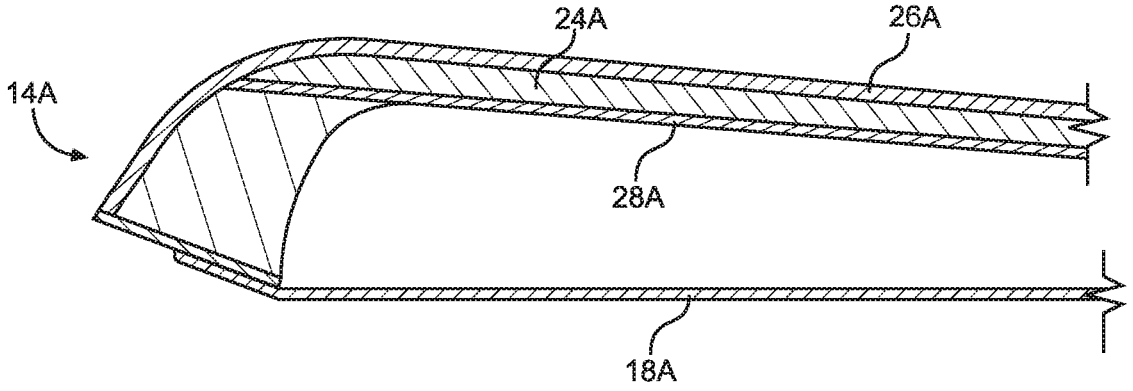
FIG. 5 is an enlarged side view like the view of FIG. 4 but showing an alternative embodiment of the invention.
Figure 6:
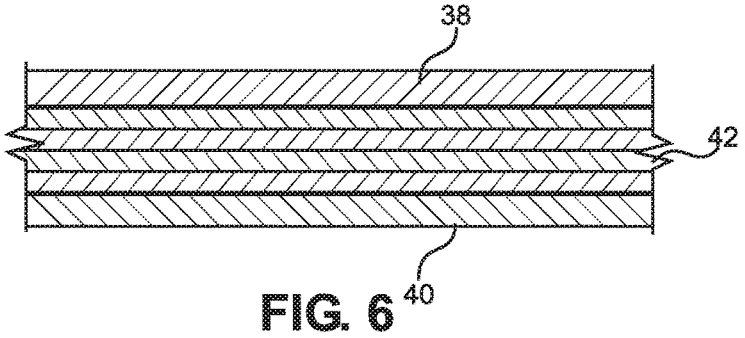
FIG. 6 is a view in cross section taken substantially along the line 3-3 of FIG. 1 illustrating an arrangement of the layers and component strips of an embodiment of the invention.
Figure 7:
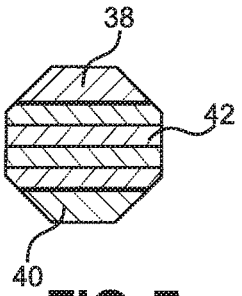
FIG. 7 is a view in cross section taken substantially along the line 7-7 of FIG. 2 illustrating the arrangement of the layers and component strips illustrated in FIG. 6.
Figure 8:
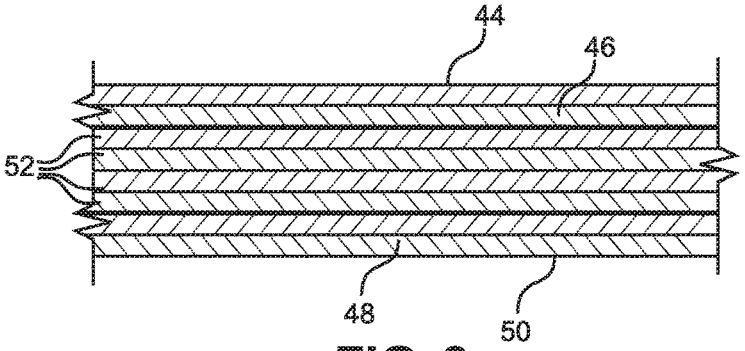
FIG. 8 is a view in cross section taken substantially along the line 3-3 of FIG. 1 illustrating an alternative arrangement of the layers and component strips of an embodiment of the invention.
Figure 9:
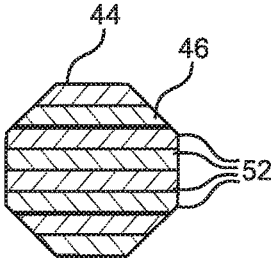
FIG. 9 is a view in cross section taken substantially along the line 7-7 of FIG. 2 illustrating the arrangement of the layers and component strips illustrated in FIG. 8.

FIGS. 3 through 5 illustrate the laminated construction of a bow shaft that has three layers, with each layer consisting of a single strip. FIGS. 6 through 12 illustrate examples of alternative forms of the three principal layers. FIGS. 6 and 7 show a top layer 38 that is a single strip, a bottom layer 40 that is a single strip and a central core layer that has four strips laminated together. FIGS. 8 and 9 show a bow shaft that has a top layer with two strips 44 and 46, a bottom layer with two strips 48 and 50 and a core layer with four strips 52. FIG. 12 also shows the bow shaft of FIGS. 8 and 9 in a cross section with the cross section taken along the line 12-12 of FIG. 2.

Figure 10:
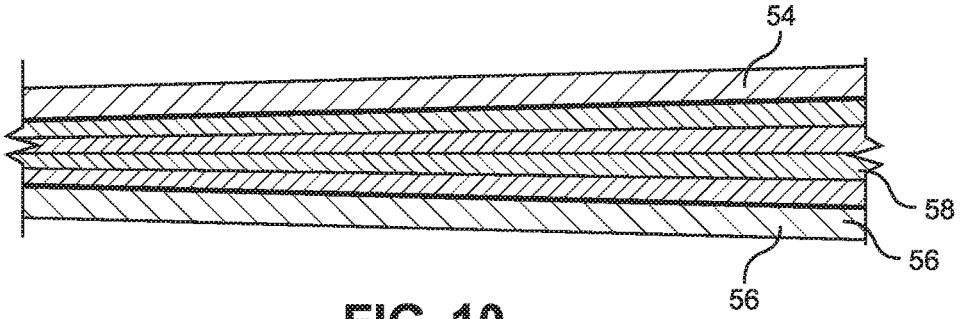
FIG. 10 is a view in cross section taken substantially along the line 3-3 of FIG. 1 illustrating another alternative arrangement of the layers and component strips of an embodiment of the invention.
Figure 11:
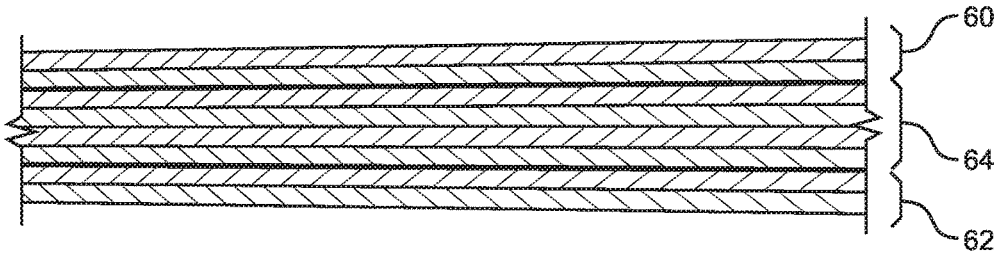
FIG. 11 is a view in cross section taken substantially along the line 3-3 of FIG. 1 illustrating yet another alternative arrangement of the layers and component strips of an embodiment of the invention.
Figure 12:
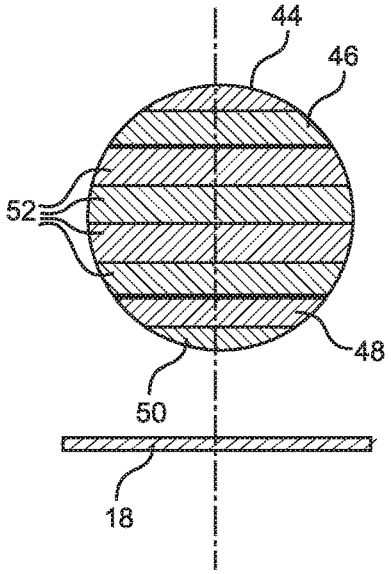
FIG. 12 is a view in cross section taken substantially along the line 12-12 of FIG. 2 illustrating yet another alternative arrangement of the layers and component strips of an embodiment of the invention.

FIGS. 10 and 11 illustrate a bow shaft in which the core layer comprises at least one strip that is longitudinally tapered to have a thickness that becomes progressively thinner as the strip progresses in a direction from the frog toward the head. More specifically, the embodiment of FIG. 10 has a top layer with one strip 54 of uniform thickness, a bottom layer with one strip 56 of uniform thickness and a central layer having four strips 58 all of which are tapered. The embodiment of FIG. 11 has all its strips tapered. Its top layer 60 consists of two strips, and its bottom layer 62 consists of two strips, both preferably constructed of bamboo strips. It also has a core layer 64 that consists of four tapered strips. The embodiments illustrated in FIGS. 3 through 11 are, of course, representative examples of some of the various combinations of the number of strips that can be laminated in each layer and various combinations of tapered strips and strips of uniform thickness that can be assembled together.

FIGS. 4 and 5 illustrate a further improvement that can conveniently be adopted in embodiments of the invention. Referring to FIG. 4, the head 14 has a distal end 27 which is the end facing longitudinally or axially away from the shaft. The top layer 26 is bent around and against the distal end 27 of the head 14 and is bonded to the distal end 27 of the head 14 by a suitable adhesive. This construction strengthens the head against breakage as a result of a sudden, longitudinally directed shear force that might be applied against the head. Such a force can, for example, be unintentionally applied to the head as a result of the shaft being accidentally dropped striking a hard surface while in a vertical orientation.

The head 14 also has a proximal end 29 facing toward the frog 16 (not visible in FIGS. 4 and 5) of the bow. Additional reinforcement against such breakage is obtained by bending the bottom layer 28 around and against the proximal end 29 of the head 14 and bonding the bottom layer 28 to the proximal end 29 of the head 14. FIG. 4 also show a tip 14 which comprises a plurality of strips 25 (five shown) that are laminated together. The strips 25 having the same orientation as the strips of the shaft and are preferably constructed of the same bamboo strips of the type previously described.

FIG. 5 shows an alternative to the embodiment of FIG. 4. In the FIG. 5 embodiment, the top layer 26A is bent around the head 14A in the manner illustrated in FIG. 4. However, the bottom layer 28A continues along the shaft and is bonded between and to the core layer 24A and to the head 14A.

Bow Fabrication Process and Method

In order to use bamboo for strips of the laminated layers of the invention, the desired part of a bamboo cane must be retrieved and processed into a suitable size and shape. A cane of bamboo is split by cutting the cane longitudinally and diametrically to form eight laterally arcuate strips that are each 45° of the circular periphery of the cane. This is easily done by a series of longitudinal saw cuts each time cutting a piece in half until there are eight pieces of equal width, typically three quarters of an inch wide. The next step is to form strips that consist of the portion of the bamboo illustrated in the rectangle in FIG. 13. An inner layer of pith and most of the flesh that is adjacent to the pith is removed from each strip by running the strip through a band saw removing the majority of the pith and flesh. The saw cut is made to leave only the epidermis, cortex and a minor layer of flesh which forms a planer surface on each strip. The strip may be further flattened along the sawn surface. Flattening, as well as other shaping operations, can be performed by machine or woodworking hand tools.

The opposite surface of each strip is then also shaped into a flat or planar surface by cutting off some of the epidermis (enamel) and sanding it if desired. If the final shaft will include strips that will be used to form laminated strips that are tapered, those strips are then shaped into a tapered, wedge shape. After shaping the opposite surfaces of each bamboo strip that will be used as strips of the laminated layers, the bamboo strips are heated to remove excess moisture. For example, bamboo may be heated to 200° C. to remove excess moisture with the added benefit of darkening the natural coloration of the bamboo. These steps provide bamboo strips that are ready for lamination to form a bow shaft or frog and button. The Bamboo strips are preferably anywhere from 1 mm to 4 mm thick depending on the type and part of the bow.

An adhesive is then applied onto the surfaces of a plurality of strips that will be interfacing within the laminated strips of resilient material. At least one strip is used to form a bottom layer and at least one strip for forming a central core layer. Preferably, only those strips used to form the bottom layer and the core layer are used in the first of two bonding and laminating steps, although the top layer alternatively can be bonded simultaneously in order to form all three layers in a single bonding and laminating step.

The strips to be bonded in the first bonding and laminating step are assembled together in laminations against a clamping form that has a contour following a desired camber. The strips are assembled with the bottom layer positioned against one jaw of the clamping form and the central core layer, consisting of one or more strips, positioned between the bottom layer and the other jaw of the clamping form. The clamping form has complementary or mating curved surfaces that have a curvature which forms the layers into a desired bow camber. With the layers clamped and pressed in the clamping form, the adhesive between the strips are cured, such as by heating or drying. After these layers are cured, the head can then be bonded to the shaft by a similar application of adhesive followed by appropriate curing of the adhesive. At this point in the process, and/or after all three layers are laminated together, the head can then be shaped into the desired style.

The reason to bond only the bottom layer and the core layer in the first bonding and laminating step is to facilitate a better fit for bonding the top layer to the core layer and also to the distal end of the head. Adhesive is applied to bond the top layer to the exposed surface of the core layer and to the head. The end portion of the top layer is bent around and against the distal end of the head. The top layer together with the previously laminated core layer and bottom layer are then clamped in the clamping form and the adhesive is cured to bond the entire top layer, included its bent end, to the core layer and the head.

After lamination and head attachment is completed and the adhesive is cured or set, the outer surface of the laminated strips and layers can be shaped into the desired shaft shape and dimensions. This shaping is preferably done according to traditional prior art shaping processes to shape the shaft and other bow components into prior art shape and dimensions. The shaping can include conventional style variations including an octagonal cross-sectional peripheral contour at the frog end with a gradual blended transition to a circular cross-sectional peripheral contour at the head end. However, on the drawings, except for FIG. 3, lines showing the peripheral surface contours are not shown because they require lines that are similar to, and therefore would be confused with, lines showing the layers and strips that are laminated together in the invention.

The finished components are then combined with other conventional components in the traditional manner including a frog, hair, button and its associated components.

These bow structures and bow making processes provide a strong, durable, and economical material for creating bows for stringed instruments that provides an equivalent strength to weight ratio, stiffness and flexibility, and mass as was typical in traditional bows of the 18th century. The lamination structure and processing will increase the supply of readily available, economically feasible and environmentally friendly bows, while retaining the structural strength and integrity of the materials. By using natural materials that are readily available, the future of bow making becomes environmentally sustainable. Laminating wood and wood-like materials that utilize fundamentally similar components and structures, such as cellulose, lignin, and xylem, will provide laminated bows with the essential characteristics that musicians demand.

According to the Encyclopedia Britannica, there are 115 genera and 1,400 species of Bamboo. The heaviest concentration of Bamboo is located in East and Southeast Asia with some species growing as much as one foot per day. Currently, Ecuadorian forests are being over-run with Bamboo. The spread of this aggressive vegetation can form a dense undergrowth that is detrimental to other plants. The use of this material for bow making can add one more purpose to bamboo's multitude of uses and products, although not all species are suitable for bow making. The use of bamboo utilizes natural materials that are readily available, environmentally friendly and internationally acceptable to Cites.

The invention provides a new bow and method of making a bow where the camber can be created by forming or pressing it around a form or mold. The bow is structurally resilient to damage and has playing qualities similar in characteristics to finer bows that the synthetic bows do not inherently display. The bow of the invention can produce an appropriate strength to weight ratio, specific gravity, and proper balance for beginners as well as sophisticated musicians. A Bamboo bow also can produce a strong sound for today's large venues while spontaneously responding to subtle displays of inflection from the professional. It can easily replace the fiberglass and carbon fiber bow with a bow that is biodegradable and economically advantageous.

REFERENCE NUMBER LIST

10 bow
12 shaft
14 head
16 frog
18 hair
20 button

22 resilient strips of the shaft
24 central core layer
25 strips of the head (FIG. 4)
26 top layer
27 distal end of head
28 bottom layer
29 proximal end of head
30 bamboo epidermis
32 bamboo cortex
34 bamboo flesh
36 bamboo pith
38 top layer (FIGS. 6 & 7)
40 bottom layer (FIGS. 6 & 7)
42 central core layer (FIGS. 6 & 7)
44 sheet of top layer (FIGS. 8 & 9)
46 second sheet of top layer (FIGS. 8 & 9)
48 sheet of bottom layer (FIGS. 8 & 9)
50 second sheet of bottom layer (FIGS. 8 & 9)
52 central core layer (FIGS. 8 & 9)
54 top layer (FIG. 10)
56 bottom layer (FIG. 10)
58 core layer (FIG. 10)
60 top layer (FIG. 11)
62 bottom layer (FIG. 11)
64 core layer (FIG. 11)

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A bow for a stringed musical instrument, the bow including a shaft, a head attached to an end of the shaft, a frog attached near an opposite end of the shaft, and hair extending between the head and the frog, the shaft comprising:

(a) a plurality of resilient strips bonded together to form laminated layers, the layers comprising,
(i) a central core layer,
(ii) a top layer bonded to a top side of the core layer, and
(iii) a bottom layer bonded to a bottom side of the core layer, the strips and the layers extending longitudinally along the shaft and oriented perpendicularly to a plane that is through a central axis of the shaft and a central axis of the hair;

wherein the top layer and the bottom layer is each formed of a resilient material having a specific gravity in the range of 0.95 to 1.2; and wherein the top layer and the bottom layer each comprise at least one strip of bamboo.

2. A bow according to claim 1 wherein each bamboo strip in the top layer and in the bottom layer consists of bamboo cortex and an adjacent layer of bamboo flesh.

3. A bow for a stringed musical instrument, the bow including a shaft, a head attached to an end of the shaft, a frog attached near an opposite end of the shaft, and hair extending between the head and the frog, the shaft comprising:

(a) a plurality of resilient strips bonded together to form laminated layers, the layers comprising,
(i) a central core layer,
(ii) a top layer bonded to a top side of the core layer, and
(iii) a bottom layer bonded to a bottom side of the core layer, the strips and the layers extending longitudinally along the shaft and oriented perpendicularly to a plane that is through a central axis of the shaft and a central axis of the hair; and wherein the head has a distal end facing away from the shaft and the top layer bends around and against the distal end of the head and is bonded to the distal end of the head.

4. A bow according to claim 3 wherein the head has a proximal end facing toward the frog and the bottom layer bends around and against the proximal end of the head and is bonded to the proximal end of the head.

5. A bow according to claim 3 wherein the central core layer comprises at least one strip longitudinally tapered to have a thickness that becomes progressively thinner as the strip progresses in a direction from the frog toward the head.

6. A bow according to claim 3 wherein the top layer and the bottom layer each comprise at least one strip of bamboo.

7. A bow according to claim 6 wherein the central core layer comprises at least two strips of wood.

8. A bow according to claim 7 wherein the central core layer comprises more than two strips of wood and the top layer and the bottom layer each comprise at least two strips of bamboo.

9. A bow according to claim 7 wherein the central core layer has at least 4 strips of wood.

10. A bow according to claim 6 wherein the head comprises a plurality of bamboo strips laminated together, the strips having the same orientation as the strips of the shaft.

11. A bow for a stringed musical instrument, the bow including a shaft, a head attached to an end of the shaft, a frog attached near an opposite end of the shaft, and hair extending between the head and the frog, the shaft comprising:

(a) a plurality of resilient strips bonded together to form laminated layers, the layers comprising,
(i) a central core layer,
(ii) a top layer bonded to a top side of the core layer, and
(iii) a bottom layer bonded to a bottom side of the core layer, the strips and the layers extending longitudinally along the shaft and oriented perpendicularly to a plane that is through a central axis of the shaft and a central axis of the hair;

wherein the central core layer comprises at least one strip longitudinally tapered to have a thickness that becomes progressively thinner as the strip progresses in a direction from the frog toward the head.

12. A method for constructing a bow for a stringed musical instrument, the method comprising:

(a) applying an adhesive on surfaces of a plurality of strips of resilient material, the strips including at least one strip for forming a bottom layer and at least one strip for forming a central core layer;
(b) assembling said strips together in laminations against a clamping form that has a contour following a camber for a bow, the strips being assembled with the bottom layer strip against one jaw of the clamping form and the central core layer between the bottom layer strip and another jaw of the clamping form;
(c) curing the adhesive with the strips clamped in the clamping form; and (d) bonding an exposed surface of the bonded core layer to a top layer strip.

13. A method according to claim 12 wherein, before applying adhesive to the layers, the method further comprises shaping at least one core-forming strip into a tapered, wedge shape.

14. A method according to claim 12 comprising, before applying adhesive, preparing strips for the bottom layer and for a top layer by:

(a) splitting a cane of bamboo by cutting the cane longitudinally and diametrically to form laterally arcuate strips;

(b) removing an inner layer of pith and some flesh that is adjacent to the pith from each strip and forming a planer surface on each strip; and (c) shaping the opposite surface of each strip into a planar surface.

15. A method according to claim 12 wherein the step of bonding an exposed surface of the bonded core layer to a top layer strip further includes bending an end portion of the top layer around a distal end of a head at an end of the bow and bonding the bent top layer sheet to the distal end of the head.

16. A method according to claim 15 wherein, after shaping the opposite surface of each Bamboo strip into a planar surface and before bonding the top layer to the core layer, the bamboo strips are heated to remove excess moisture.

* * * * *